US009909306B2

(12) United States Patent
Dolby et al.

(10) Patent No.: US 9,909,306 B2
(45) Date of Patent: Mar. 6, 2018

(54) MANUFACTURES, METHODS AND STRUCTURES TO REDUCE ENERGY TRANSFER IN BUILDING CURTAIN WALLS

(71) Applicants: Jeffrey Scott Dolby, Buford, GA (US); Gregory Blake McKenna, Cumming, GA (US); Nick Napora, Broadway, VA (US)

(72) Inventors: Jeffrey Scott Dolby, Buford, GA (US); Gregory Blake McKenna, Cumming, GA (US); Nick Napora, Broadway, VA (US)

(73) Assignee: Arconic Inc., Pittsburgh, PA (US)

( * ) Notice: Subject to any disclaimer, the term of this patent is extended or adjusted under 35 U.S.C. 154(b) by 135 days.

(21) Appl. No.: 15/041,807

(22) Filed: Feb. 11, 2016

(65) Prior Publication Data

US 2017/0022708 A1 Jan. 26, 2017

Related U.S. Application Data

(60) Provisional application No. 62/194,665, filed on Jul. 20, 2015.

(51) Int. Cl.

| | |
|---|---|
| ***E04B 2/96*** | (2006.01) |
| ***E04B 1/76*** | (2006.01) |
| ***E06B 3/54*** | (2006.01) |
| ***E04B 2/90*** | (2006.01) |

(52) U.S. Cl.

CPC ..... *E04B 2/967* (2013.01); *E04B 1/76* (2013.01); *E04B 2/90* (2013.01); *E06B 3/5481* (2013.01)

(58) Field of Classification Search

CPC . E04B 2/96; E04B 2/885; E04B 2/967; E04B 2/965; E06B 3/5427; E06B 3/6715; E06B 3/305

See application file for complete search history.

(56) References Cited

U.S. PATENT DOCUMENTS

| | | | | | |
|---|---|---|---|---|---|
| 3,307,314 | A * | 3/1967 | Varlonga | E04B 1/24 | 52/461 |
| 3,381,434 | A * | 5/1968 | Carson | E04B 2/967 | 52/204.591 |
| 3,466,826 | A * | 9/1969 | Gallagher | E04B 2/96 | 49/DIG. 1 |
| 3,858,375 | A * | 1/1975 | Silvernail | E04B 2/96 | 52/209 |
| 4,031,680 | A * | 6/1977 | Stoakes | E04B 2/965 | 52/204.597 |
| 4,055,923 | A * | 11/1977 | Biebuyck | E06B 7/14 | 52/204.591 |
| 4,283,895 | A * | 8/1981 | Sukolics | E06B 3/26338 | 411/55 |

(Continued)

*Primary Examiner* — Gisele Ford

(74) *Attorney, Agent, or Firm* — Greenberg Traurig, LLP

(57) ABSTRACT

A manufacture and method for reducing thermal transfer through window systems has a composite window cap retainer. The retainer has a metal extrusion at least partially covered by a thermal spacer having reduced relative thermal conductivity. The thermal spacer is mechanically supported by the metal extrusion and mechanically intermediates and thermally insulates between the cap and the metal window structures to which the cap is secured, reducing thermal transfer between the inside and outside environments of a building.

25 Claims, 8 Drawing Sheets

(56) References Cited

U.S. PATENT DOCUMENTS 4,418,506 A * 12/1983 Weber ..... E04B 2/967 52/204.593
4,428,171 A * 1/1984 Harbin ..... E04B 2/965 49/DIG. 1
4,608,793 A * 9/1986 Yost ..... E06B 7/14 52/204.597
4,638,613 A * 1/1987 Tonsmann ..... E04B 1/24 52/200
4,756,132 A * 7/1988 Newman ..... E04B 2/965 52/235
5,253,459 A * 10/1993 Parinas ..... E04B 2/96 52/204.591
5,309,689 A * 5/1994 Croissant ..... E04B 2/967 52/235
5,355,645 A * 10/1994 Farag ..... E06B 3/5427 52/235
5,381,637 A * 1/1995 Farag ..... E06B 3/5427 52/204.593
5,481,839 A * 1/1996 Lang ..... E04B 2/967 52/235
5,579,616 A * 12/1996 Farag ..... E06B 3/5427 52/204.5
5,592,795 A * 1/1997 Rinehart ..... E04B 2/967 52/204.591
5,839,236 A * 11/1998 Frey ..... E04B 2/965 52/235
6,141,923 A * 11/2000 Habicht ..... E04B 1/943 52/232
6,202,382 B1 * 3/2001 Conterno ..... E04C 2/543 52/235
6,269,601 B1 * 8/2001 Kenny ..... E06B 3/5427 428/192
6,390,718 B1 * 5/2002 Steege ..... B62D 1/184 280/775
7,434,790 B1 * 10/2008 Hansen ..... E04F 11/1851 256/19
7,975,442 B1 * 7/2011 Frey ..... E04B 2/967 52/204.5
8,800,221 B1 * 8/2014 Header ..... E04B 2/88 52/204.5
2002/0124499 A1 * 9/2002 Braybrook ..... E04B 2/96 52/235
2003/0226324 A1 * 12/2003 Hogan ..... E04B 2/96 52/235
2006/0185274 A1 * 8/2006 Merica ..... E04B 2/90 52/235
2006/0201084 A1 * 9/2006 Arias ..... E04B 2/965 52/235
2008/0222978 A1 * 9/2008 Salzer ..... E06B 5/116 52/202
2010/0293882 A1 * 11/2010 Labrecque ..... E04B 2/967 52/705
2011/0138727 A1 * 6/2011 Labrecque ..... E04B 2/965 52/483.1
2011/0167743 A1 * 7/2011 Ting ..... E04B 2/96 52/235
2013/0180189 A1 * 7/2013 Reifer ..... E04B 2/967 52/204.593
2014/0245689 A1 * 9/2014 Voegele ..... E04B 2/967 52/506.08
2015/0284951 A1 * 10/2015 Frederick ..... E04B 2/965 52/235

* cited by examiner

MANUFACTURES, METHODS AND STRUCTURES TO REDUCE ENERGY TRANSFER IN BUILDING CURTAIN WALLS

CROSS REFERENCE TO RELATED APPLICATIONS

This application claims the benefit of U.S. Provisional Application Ser. No. 62/194,665, filed Jul. 20, 2015 and entitled, Manufactures, Methods and Structures to Reduce Energy Transfer in Building Curtain Walls.

FIELD

The present invention relates to building products and more particularly, to window structures, window frames, curtain walls and curtain wall assemblies.

BACKGROUND

Some windows utilize frames made from metal, e.g., aluminum alloy. Metal windows are in use in residential and commercial buildings, e.g., in storefronts and in curtain walls used on the façade of high-rise buildings. The energy transfer characteristics of windows are an important factor in the overall energy efficiency of a building and there is a continued demand for building features and methods of construction that improve energy efficiency. Aesthetic considerations also play an important part in architectural design, including the design of window systems and curtain walls. Improved and/or alternative structures and methods for controlling the heat transfer characteristics of windows, window structures, curtain walls and curtain wall assemblies and for achieving aesthetic design objectives remain desirable.

SUMMARY

The disclosed subject matter relates to a window system for a building including a chassis secured to the building. The chassis has a structural element supporting a glazing unit and the structural element has a niche therein along at least a portion of a length thereof. At least one glazing unit is secured to the structural element adjacent the niche. A cap covers an edge of the at least one glazing unit and a cap retainer is inserted into and retained in the niche at one end and attaching to the cap at the other end. The cap retainer has a first portion made from a material having a first thermal conductivity and a second portion made from a material having a thermal conductivity less than the thermal conductivity of the first material, the second portion interposed between the cap and the niche.

In another embodiment, the cap retainer is capable of supporting the at least one glazing unit under the influence of gravity.

In another embodiment, the first portion is a metal extrusion and the second portion is non-metallic and at least partially covers the first portion.

In another embodiment, the second material is a polymer material.

In another embodiment, the first material is an aluminum alloy.

In another embodiment, the second portion is positioned below the first portion and rests on a surface of the niche at a contact area, the cap retainer pivoting on the contact area when subjected to a down-force.

In another embodiment, the cap retainer has a hook at an end thereof that is received in the niche and the niche has a hook recess therein that matingly receives the hook when the cap retainer is inserted in the niche.

In another embodiment, the niche has two hook recesses, a first for accommodating the hook when the cap retainer is inserted to a first extent into the niche a second for accommodating the hook when the cap retainer is inserted into the niche to a second extent.

In another embodiment, the second portion has end grips wrapping around a plurality of edges of the first portion.

In another embodiment, the first portion is made from a material having a greater mechanical strength than the second portion and stiffens the second portion when conjoined therewith.

In another embodiment, the second portion is polyamide.

In another embodiment, the cap has a hollow gripper and the cap retainer has an insertion tip that is slideably insertable into the hollow gripper to a gripping position where the hollow gripper and insertion tip interlock to retain the cap on the window system.

In another embodiment, the hollow gripper has a disengagement tab that permits disengagement of the hollow gripper from the insertion tip.

In another embodiment, the second portion may be telescoped into the first portion.

In another embodiment, further comprising an adapter inserted into the niche, the adapter having a Y-portion from which a niche hook, a niche engagement leg and a retainer support leg extends, the niche hook of the adapter received in a first hook recess in the niche, the niche engagement leg received in a recess in the niche and the support leg providing a support surface upon which the cap retainer rests and pivots when inserted into the niche after the adapter, the cap retainer niche hook received in the second hook recess in the niche.

In another embodiment, the cap is vertically oriented when in place on the window system and wherein the cap retainer is secured to the chassis by a fastener.

In another embodiment, the cap is connected to the second portion.

In another embodiment, the structural element and the cap are horizontally oriented.

In another embodiment, the cap covers edges and a gap between a pair of adjacent glazing panels.

In another embodiment, a cap retainer for holding an extruded aluminum cap on an extruded aluminum chassis of a window system has a first portion made from a polymer extrusion and a second portion made from an aluminum alloy extrusion, the first portion at least partially covering the surface of the second portion and mechanically coupling to the second portion, the first portion being interposed between the aluminum chassis and the cap, the cap attaching to an end of the first portion.

In another embodiment, a window system for a building includes a chassis secured to the building, the chassis having a structural element supporting a glazing unit, the structural element having a hollow therein along at least a portion of a length thereof; at least one glazing unit secured to the structural element adjacent the hollow; a cap covering an edge of the at least one glazing unit; a cap retainer inserted into the hollow and attached to the structural element within the hollow and attaching to the cap at one end, the cap retainer being a monolithic polymer having a thermal conductivity less than the thermal conductivity of the structural element, the cap retainer interposed between the cap and the niche.

In another embodiment, the structural element and the cap are aluminum alloy, the cap has a gripper with a hollow and at least one flexible wall and the cap retainer has a tapered insertion head that inserts into the hollow of the gripper.

In another embodiment, the gripper has a release lever extending from the flexible wall that selectively opens the gripper when pressed to allow withdrawal of the insertion head.

In another embodiment, the separation distance between the cap and the structural element is greater than ¼ inch. In another embodiment, the separation distance between the cap and the structural element is greater than 1 inch.

BRIEF DESCRIPTION OF THE DRAWINGS

For a more complete understanding of the present disclosure, reference is made to the following detailed description of exemplary embodiments considered in conjunction with the accompanying drawings.

DETAILED DESCRIPTION OF EXEMPLARY EMBODIMENTS

Figure 1:
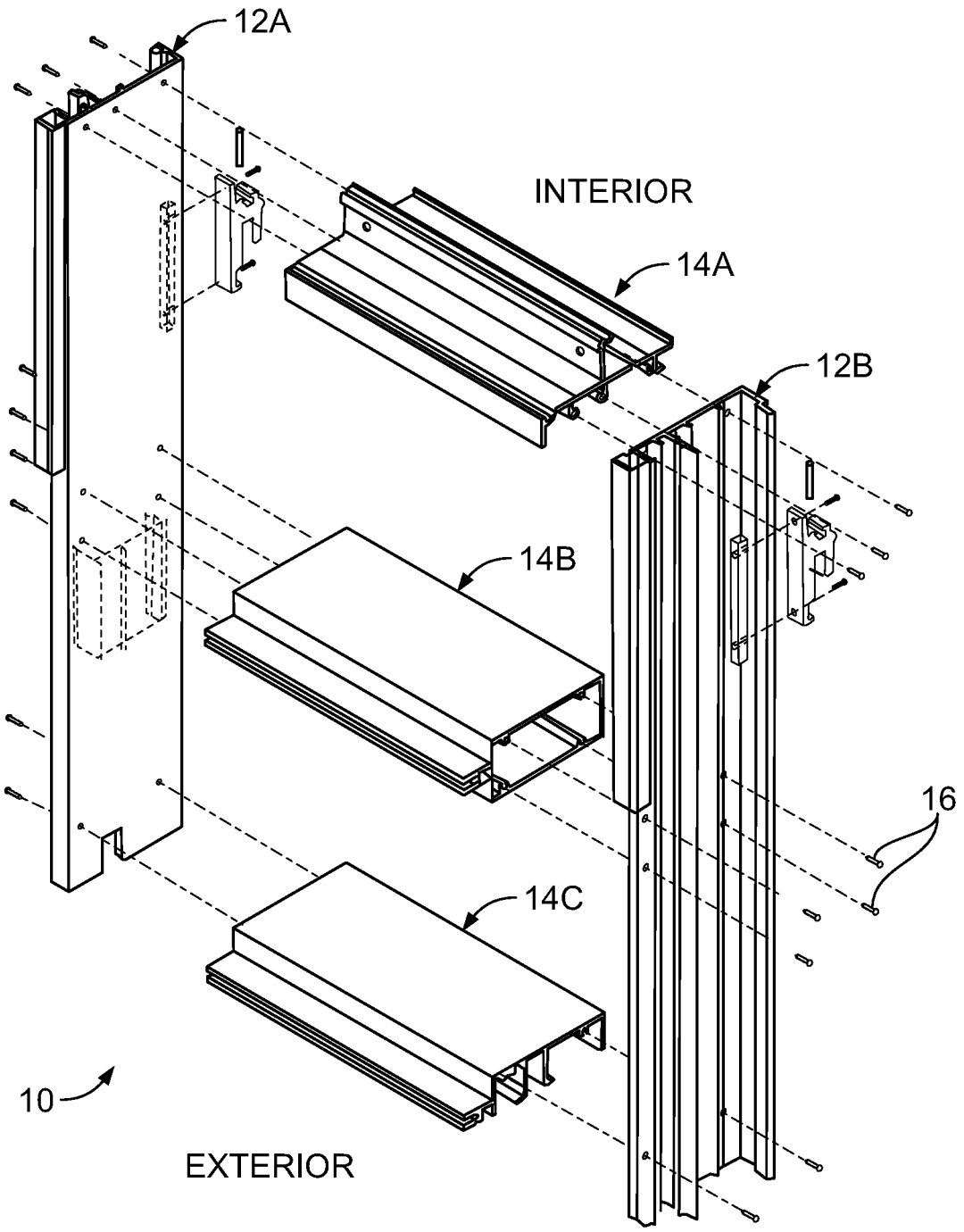
FIG. 1 is an exploded, perspective view of a prior art curtain wall chassis subassembly.

FIG. 1 shows a prior art curtain wall chassis subassembly 10 having vertical elements 12A, 12B and horizontal elements 14A, 14B, 14C that may be used to frame and hold glazing panels, e.g. 24A-24J (FIG. 2), one or more panes of window glass, polycarbonate or other clear, translucent, tinted or opaque panels. In modern construction, the glazing panels 24A-J are typically double or triple glazed with air, inert gas and/or plastic film(s) between adjacent panels to control transmission of thermal energy by radiation and convection between an interior of a building and the exterior environment. The curtain wall chassis subassembly 10 shown would typically be made for a large commercial building, such as a skyscraper, and have vertical elements 12A, 12B and horizontal elements 14A, 14B, 14C extruded from an aluminum alloy, which is strong, light-weight and corrosion-resistant. The technology of the present disclosure may also be applied to smaller buildings. The vertical elements 12A, 12B and horizontal elements 14A, 14B, 14C may be joined by screws 16 or other fastening means, such as rivets, or welding to form the chassis subassembly 10.

Figure 2:
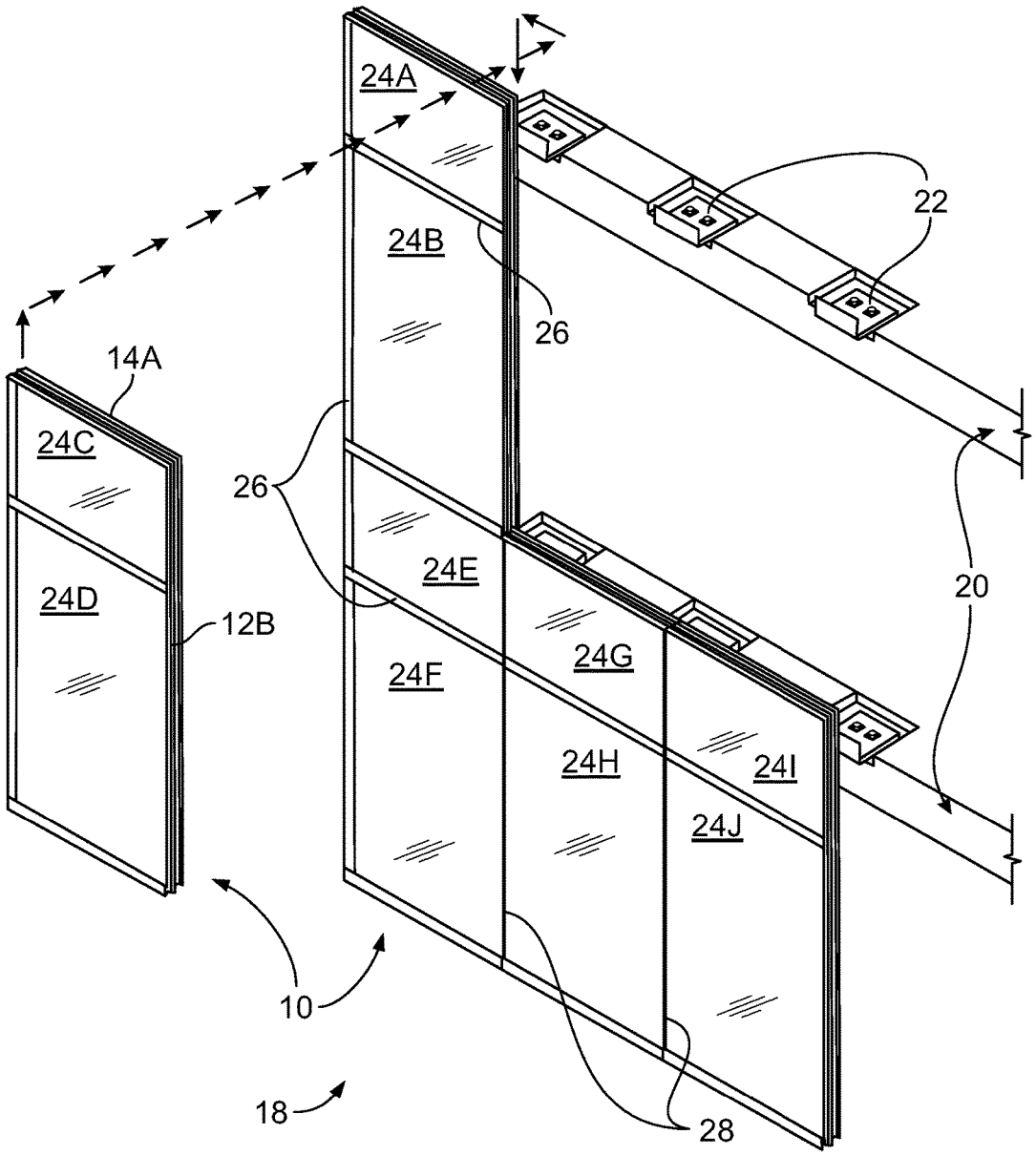
FIG. 2 is an exploded, perspective view of a plurality of glazed curtain wall subassemblies assembled to form a portion of a curtain wall on a building structure.

FIG. 2 shows a plurality of glazed curtain wall chassis subassemblies 10 assembled to form a portion of a curtain wall 18 on a building structure (beams) 20 via coupling to one another and to brackets 22 tied to the building structure 20. The subassemblies 10 have glazing units (e.g., glass) 24A-J installed therein between the vertical and horizontal elements (12B and 14A shown). While a principle method for holding the glazing units 24A-J to the chassis subassemblies 10 is by way of a silicone adhesive/sealer, cap elements (caps) 26 may be utilized to provide an architectural finishing detail between adjacent glazing units 24A-J and/or to provide a device for supporting the glazing units 24A-J in place on the curtain wall 18, e.g., as a back-up or supplemental support for a glazing unit, which is adhered to the chassis subassembly 10. Moreover, in accordance with the present disclosure, the caps 26 may be used to insulate the gap 28 between adjacent glazing units, e.g., 24A, 24B and exclude foreign materials, such as dirt, leaves, paper, insects (bees/wasps, etc.), birds, etc. from the gap 28 and/or to reduce wind noise generated by air flowing through or proximate the gap 28.

Figure 3:
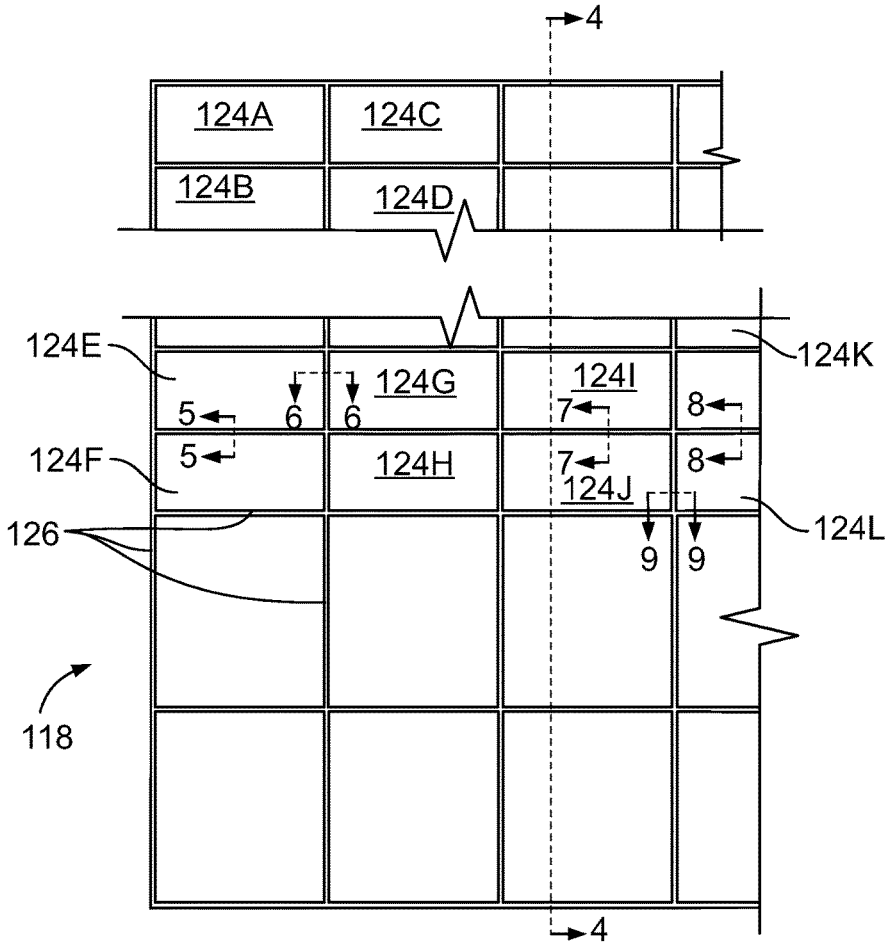
FIG. 3 is an elevational view of a curtain wall.
Figure 4:
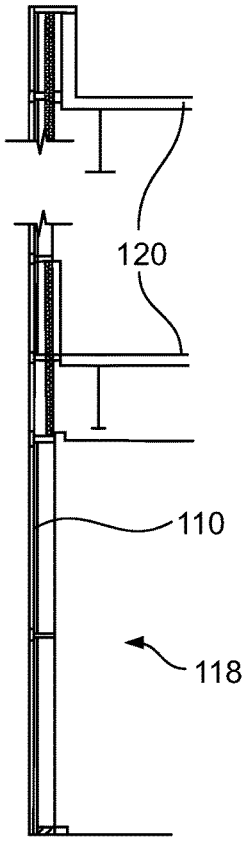
FIG. 4 is a cross-sectional view of the curtain wall of FIG. 3 taken along line 4-4 and looking in the direction of the arrows.

FIGS. 3 and 4 show a curtain wall 118 having similar attributes to those described above in relation to FIGS. 1 and 2, such as a plurality of glazing units 124A-L and caps 126. The chassis subassemblies 110 are fastened to the building structure 120 to form curtain wall 118. Curtain wall 118 is "fully captured" in that the glazing units 124A-L are surrounded on all sides by cap elements 126 in the vertical and horizontal directions. For purposes of illustration, the curtain wall 118 has features that are in accord with the prior art (for comparison purposes) and also in accordance with embodiments of the present disclosure. More particularly, the structures revealed at the cross-sections taken at lines 5-5 and 6-6 and shown in FIGS. 5 and 6, respectively, represent structures in accord with the prior art. The structures revealed at the cross-sections taken at lines 7-7 and 8-8 and 9-9 and shown in FIGS. 7, 8 9 and 10, respectively, represent structures in accord with the present disclosure. While it would be possible to have a single curtain wall with multiple structural approaches, e.g., in the case of a building in which the structural approach is changed when partially completed to take advantage of new designs, the normative approach is to have consistent structural design throughout and the mixed arrangement shown in FIGS. 3-10 is for illustration.

Figure 5:
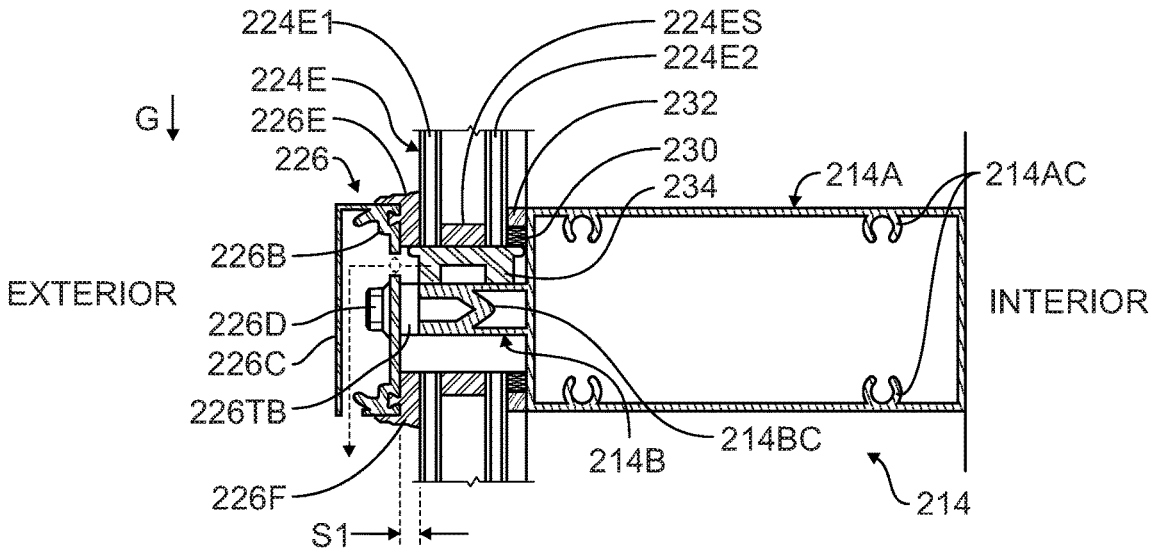
(PRIOR ART) FIG. 5
FIG. 5 is a cross-sectional view of a prior art horizontal beam, glazing and cap of a curtain wall, e.g., taken at section line 5-5 on FIG. 3 and looking in the direction of the arrows.

FIG. 5 shows a prior art horizontal element 214 in the form of an aluminum extrusion having a box portion 214A with screw channels 214AC that allow connection to vertical elements like 12A, 12B of FIG. 1 via a plurality of screws 16 or other fasteners. The horizontal element 214 has a tongue 214B with a tongue cavity 214BC for supporting and positioning an upper glazing panel 224E under the influence of gravity G. In FIG. 5, the glazing panel 224E has a first glass panel 224E1 and a second glass panel 224E2 with a spacer 224ES there between, a conventional "double-glazed" arrangement. A lower glazing panel 224F is similarly constructed. Each glazing panel 224E, 224F is adhered to the horizontal member 214 by a bead of silicone seal 230. A gasket 232 may be used to form a consistent thickness of the silicone seal 230. A polymer/elastomeric setting block 234 may be used to position the glazing panel 224E vertically relative to the horizontal element 214 (and the remainder of the curtain wall chassis 10 (FIG. 1) in which it is received, when the glazing panel 224E is adhered by the silicone seal 230. A cap assembly 226 with a base plate 226B (elongated extrusion) is retained in association with the tongue 214B by one or more bolts 226D extending through a thermal barrier 226 TB the base plate 226B and into the tongue cavity 214BC. A cap cover 226C is snap-fitted onto the base plate 226B, covering the bolt(s) 226D. First and second cap gaskets 226E, 226F press against the glazing panels 224E, 224F when the base plate 226B is in place. The distance S1 between the extruded aluminum cap assembly 226 and the tongue 214B is on the order of about ⅛ to ¼ inch and the separation gap may be filled with an elastomer, which is capable of thermal conduction, e.g., by convection and radiation.

An aspect of the present disclosure is the recognition that the cap assembly 226, bolt 226D, tongue 214B and box portion 214A (which are typically fabricated from metal, e.g., the bolt 226D is made from steel and the box portion 214A is made from extruded aluminum alloy, to provide the necessary material strength and architectural appearance for the application) constitute a conductive pathway for thermal energy between the exterior environment of a building and the climate controlled interior of the building. An aspect of the present disclosure is a system for securing caps like 226 to a window system 118 that has reduced conductivity to thermal energy. Another aspect of the present disclosure is the recognition that the process of securing a cap assembly 226 to a window chassis element, e.g., 214 via bolts/screws is labor intensive and that a system that does not employ a threaded attachment may promote ease and economy of assembly.

Figure 6:
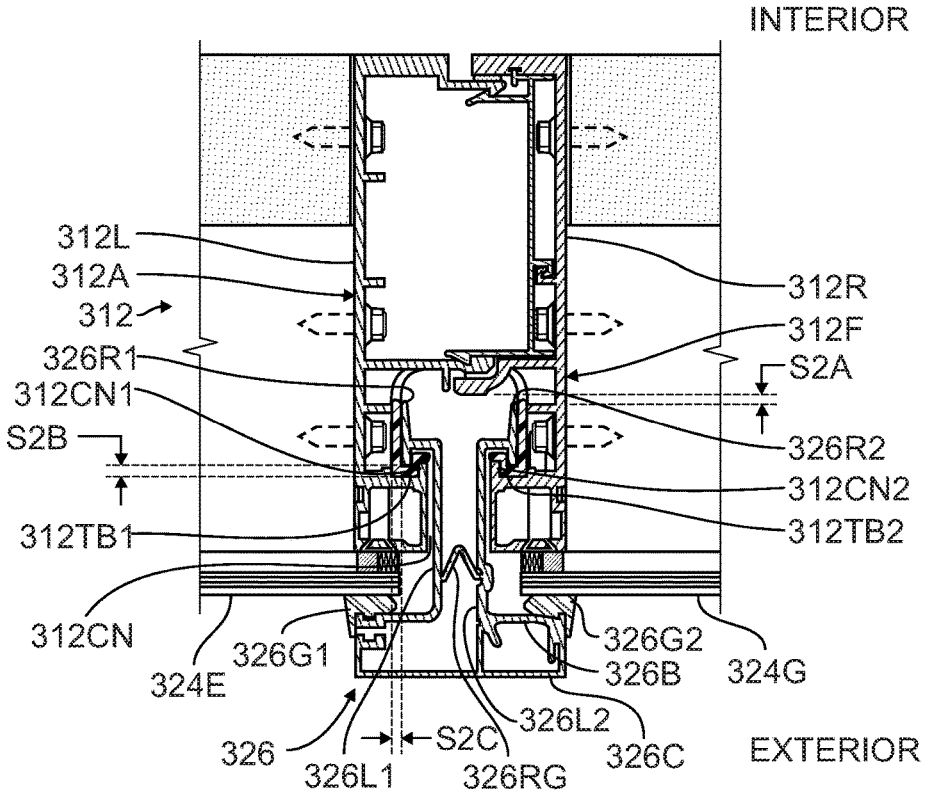
(PRIOR ART) FIG. 6
FIG. 6 is a cross-sectional view of a prior art vertical mullion, glazing and cap of a curtain wall, e.g., taken at section line 6-6 on FIG. 3 and looking in the direction of the arrows.

FIG. 6 shows a prior art composite vertical element 312 in the form of a pair of mating aluminum extrusions 312R and 312L, which snap together and, when assembled, feature a rear portion 312A and a front portion 312F that interacts with glazing panels 324E, 324G (in this instance, single-glazed) and a vertical cap assembly 326. The vertical cap assembly 326 is made from metal, e.g., extruded aluminum alloy and has a pair of legs 326L1, 326L2 with corresponding retainers 326R1, 326R2 at one end thereof. A base plate 326B serves as a mounting point for gaskets 326G1 and 326G2, as well as, snap-fit cover 326C. The cap assembly 326 is secured in place by inserting the legs 326L1 and 326L2 and retainers 326R1, 326R2, into a channel 312CN within the vertical member 312 front portion 312F with the retainers 326R1, 326R2 engaging the channel 312CN and preventing withdrawal past channel members 312CN1, 312CN2. Thermal barriers 312TB1 and 312TB2 may be interposed between the retainers 326R1, 326R2 and the channel members 312CN1, 312CN2 to prevent direct contact. A gasket 326RG may be used to divide the space within the channel 312CH, providing an additional thermal zone. As with the cap 226C, a metal vertical cap assembly 326 acts as a conductor of thermal energy between the exterior environment of the building and the climate controlled interior of the building. The distances S2A, S2B and S2C between the retainers 326R1, 326R2 (which are in thermal conductive continuity with the extruded aluminum cap assembly 326) and the front portion 312F at channel 312CN1 and 312CN2 and the rear portion 312R of the vertical element 312 is on the order of about ⅛ to ¼ inch and the separation gap is filled with a polymeric material, which is capable of thermal conduction, e.g., by convection and radiation.

Figure 7:
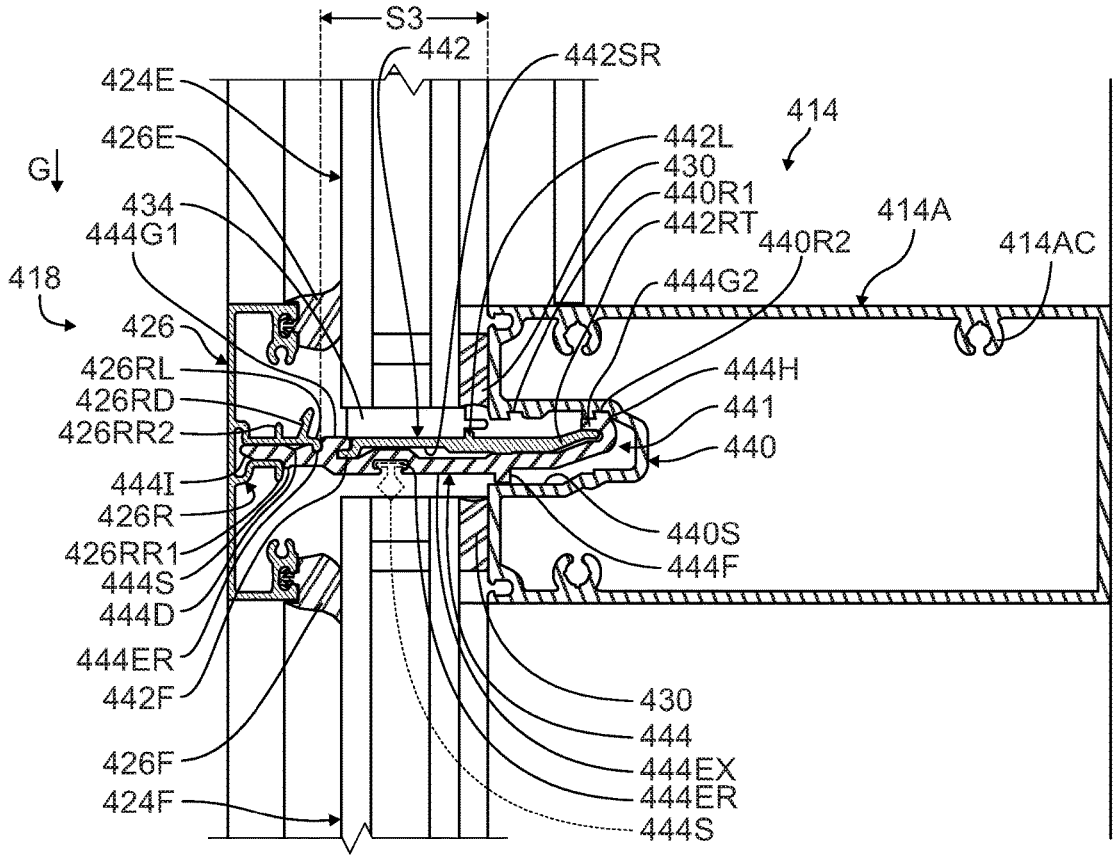
FIG. 7 is a cross-sectional view of a horizontal beam, glazing and cap of a curtain wall, in accordance with an embodiment of the present disclosure, taken at section line 7-7 on FIG. 3 and looking in the direction of the arrows.

FIG. 7 shows an embodiment of the present disclosure with a horizontal element 414 (extrusion) having a box portion 414A with screw channels 414AC and an inwardly directed niche 440. The niche 440 has first and second canted spacer engagement recesses 440R1, 440R2 for interacting with a glass support and cover retention assembly 441 in two alternative (index) positions, as shall be described below. The glass support and cover retention assembly 441 has a glass support plate (metal extrusion) 442 with a setting block positioning bead 442L and a front bead 442F. The glass support plate 442 assembles with a thermal spacer 444, e.g., made from a polymer, such as polyamide or fiberglass, to form the glass support and cover retention assembly 441. The glass support and cover retention assembly 441 may be used to support a glazing panel 424E, e.g., during adherence via a silicone seal 430. In addition, the glass support and cover retention assembly 441 may be used to secure a cover assembly 426 in place. The cover assembly 426, which may be an aluminum extrusion, has a receiver 426R with strengthening ribs 426RR1, 426RR2 and a disengagement tab 426RD. The disengagement tab 426RD acts as a lever on engagement lip 426RL, which interacts with thermal spacer 444, as described further below. The cover assembly 426 has first and second cap gaskets 426E, 426F for forming a seal with the glazing panels 424E, 424F. The thermal spacer 444 is assembled to the glass support plate 442 with the front bead 442F extending into a first plate grip 444G1 and a rear tang 442RT extending into a second plate grip 444G2. Since both the support plate 442 and the thermal spacer 444 may be elongated extrusions having the cross-sectional shape shown, the support plate 442 may be slid (telescoped) into engagement with the thermal spacer 444 to achieve the relative position shown in FIG. 7 and assemble the glass support and cover retention assembly 441. Once assembled, the glass support and cover retention assembly 441 may be used to retain the cover assembly 426 by inserting niche engagement hook 444H into niche recess 440R2 and resting the foot 444F of the thermal spacer 444 on an inside surface 440S of the niche 440. Any down force exerted by the glazing panel 424E (transmitted through setting block 434) on the glass support and cover retention assembly 441 forward of the foot 444F will pivot the assembly 441 on the foot 444F and rotate the niche engagement hook 444H into firmer engagement with niche recess 440R2. Any pull exerted by the cap assembly 426 on the glass support and cover assembly 441 also pulls the niche engagement hook 444H into firmer engagement with niche recess 440R2.

Once in place within the niche 440, the glass support and cover retention assembly 441 may be used to retain the cover assembly 426. More particularly, the cover assembly 426 may be brought into registration with the glass support and cover retention assembly 441 allowing insertion of the insertion tip 4441 into the retainer 426R up to the stop bead 444S, whereupon the engagement lip 426RL snaps into engagement with engagement recess 444ER. A disengagement relief 444D in the insertion tip 4441 permits the deflection of the wall of the retainer 426R between the rib 426RR2 and the disengagement tab 426RD to facilitate disengagement from the curtain wall 418 when desired, e.g., to replace a broken glazing panel 426E. A tool (not shown), such as an angled lever, may be forced between the gasket 426E and the glazing panel 424E to pry against the disengagement tab 426RD to disengage the engagement lip 426RL from the engagement recess 444ER to remove the cover assembly 426. The extension 444EX of the thermal spacer 444 between the foot 444F and the insertion tip 4441 may feature a seal recess 444ER for receiving a weather seal 444S (shown in dotted lines). The support plate 442 may feature a recess 442SR to accommodate the thermal spacer 444 proximate the seal recess 444ER. The distance S3 between the retainer 426R, which is in thermal conductive continuity with the extruded aluminum cap assembly 426, and the horizontal element 414 is greater than 1 inch. This magnitude of separation gap S3 reduces the thermal conductivity between the cap assembly 426 and the horizontal element 414 by about 30% over prior art structures, e.g., as described above relative to FIG. 5. In one example, a prior art structure having a glazing unit with thermal conductivity of 0.24 in combination with the prior art approach as shown in FIG. 5 would have a resultant conductivity of 0.46, but with the approach shown in FIG. 7 would have a conductivity of 0.33.

Figure 8:
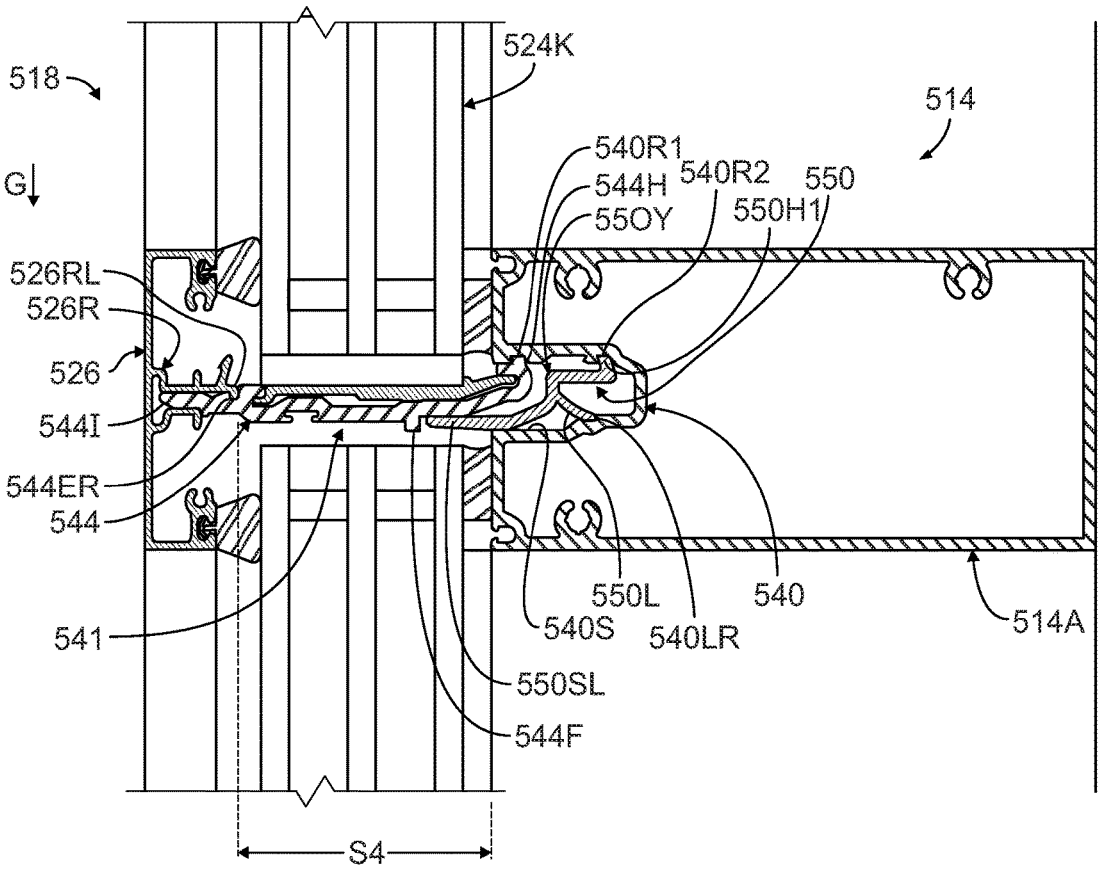
FIG. 8 is a cross-sectional view of a horizontal beam, glazing and cap of a curtain wall, in accordance with an embodiment of the present disclosure, taken at section line 8-8 on FIG. 3 and looking in the direction of the arrows.

FIG. 8 shows an alternative embodiment of the present disclosure similar to that shown in FIG. 7, but wherein a glass chair adapter 550 is utilized to shift the glass support and cover retention assembly 541 forward in the niche 540 in order to accommodate a thicker (triple glazed) glazing panel 524K. The glass chair adapter 550 has a Y-portion 550Y from which extends a first niche engagement hook 550H1 that is received in niche recess 540R2. A niche engagement leg 550L extends from the Y-portion 550Y and is received in leg reception recess 540LR in the niche 540. The glass chair adapter 550 may be an aluminum alloy extrusion. A support leg 550SL also extends from the Y-portion 550Y and rests on surface 540S on the niche 540. Once the glass chair adapter 550 is in place in the niche 540, the glass support and cover retention assembly 541 may be inserted into the niche 540 with the niche engagement hook 544H engaged with the first spacer engagement recess 540R1. Since the glass support and cover retention assembly 541 does not extend as far into the niche 540, the foot 544F of the thermal spacer 544 does not contact the niche support surface 540S and a portion of the spacer 544 rearward of the foot 544F rests and pivots upon the support leg 550SL of the glass chair adapter 550 when subjected to down-force in the direction of the force of gravity G. As in the embodiment of FIG. 7, the cover assembly 526 may be brought into registration with the glass support and cover retention assembly 541 allowing insertion of the insertion tip 5441 into the retainer 526R, whereupon the engagement lip 526RL snaps into engagement with engagement recess 544ER to retain the cover assembly 526 in removable association with the curtain wall 518. The distance S4 between the retainer 526R, which is in thermal conductive continuity with the extruded aluminum cap assembly 526, and the horizontal element 514 is greater than 1 inch. This magnitude of the separation gap S4 reduces the thermal conductivity between the cap assembly 526 and the horizontal element 514 by 30% over prior art structures, e.g., as described above relative to FIG. 5.

Figure 9:
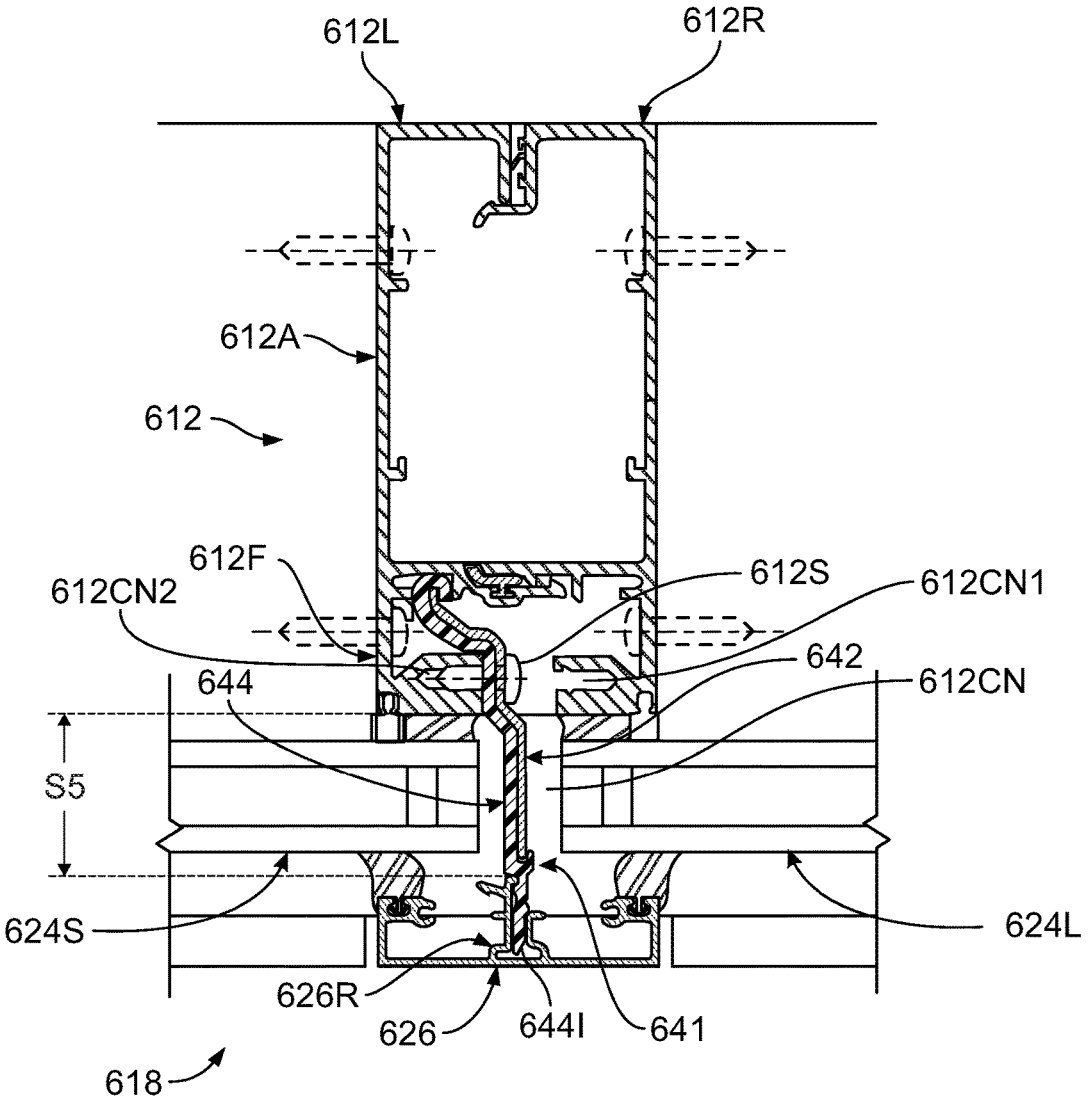
FIG. 9 is a cross-sectional view of a vertical mullion, glazing and cap of a curtain wall in accordance with an embodiment of the present disclosure, taken at section line 9-9 on FIG. 3 and looking in the direction of the arrows.

FIG. 9 shows another embodiment of the present disclosure as applied to a composite vertical element 612 formed from a pair of mating aluminum extrusions 612R, 612L that are coupled together in a snap-fitting relationship. The composite vertical element 612 has a rear portion 612A and a front portion 612F with channel 612CN. Fastener recesses 612CN1, 612CN2 are formed in the front portion 612F for receiving fasteners 612S, such as rivets or screws, for securing a glass support and cover retention assembly 641. The glass support and cover retention assembly 641 features a support plate 642 and a thermal spacer 644 that are conjoined in a similar manner as in the glass support and cover retention assemblies 441 and 541 of prior embodiments, but also by the action of the fastener(s) 612S, which extends through each. As in the preceding embodiments of FIGS. 7 and 8, the receiver 626R receives the insertion tip 6441 of the thermal spacer 644 and interlocks there with to secure the cover assembly 626 to the curtain wall 618. The distance S5 between the retainer 626R, which is in thermal conductive continuity with the extruded aluminum cap assembly 626, and the vertical element 612 is greater than 1 inch. This magnitude of the separation gap S5 reduces the thermal conductivity between the cap assembly 626 and the vertical element 612 by about 30% over prior art structures, e.g., as described above relative to FIG. 6.

Figure 10:
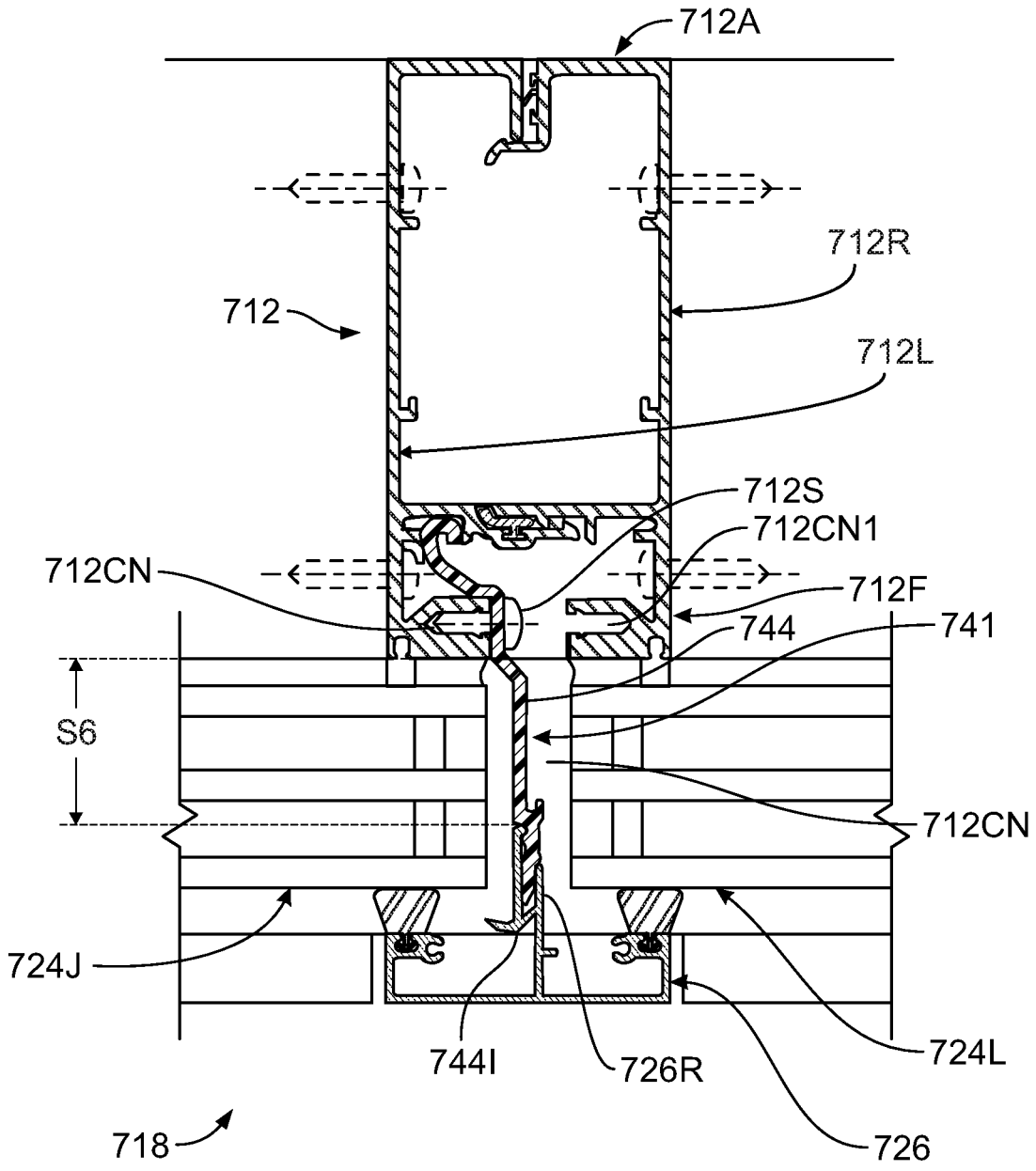
FIG. 10 is a cross-sectional view of a vertical mullion, glazing and cap of a curtain wall like FIG. 9 in accordance with another embodiment of the present disclosure.

FIG. 10 shows another embodiment of the present disclosure analagous to FIG. 9, but applied to triple glazed panels 724J, 724L. As before, a composite vertical element 712 formed from a pair of mating aluminum extrusions 712R, 712L are coupled together in a snap-fitting relationship. The composite vertical element 712 has a rear portion 712A and a front portion 712F with channel 712CN. Fastener recesses 712CN1, 712CN2 are formed in the front portion 712F for receiving fasteners 712S, such as rivets or screws, for securing a glass support and cover retention assembly 741. In the embodiment shown, the glass support and cover retention assembly 741 features only a thermal spacer 744. If desired, a support plate like 642 of FIG. 9 could be conjoined to the thermal spacer 744 in a manner similar to that shown in FIG. 9. The receiver 726R receives the insertion tip 7441 of the thermal spacer 744 and interlocks there with to secure the cover assembly 726 to the curtain wall 718. The distance S6 between the retainer 726R, which is in thermal conductive continuity with the extruded aluminum cap assembly 726, and the vertical element 712 is greater than 1 inch. This magnitude of the separation gap S6 reduces the thermal conductivity between the cap assembly 726 and the vertical element 712 by about 30% over prior art structures, e.g., as described above relative to FIG. 6.

In each of the embodiments of FIGS. 7, 8, 9 and 10, a metal cover assembly 426, 526, 626, 726 is securely connected to a curtain wall system 418, 518, 618, 718 via a simple snap fit that is accomplished without tools. The thermal transmission from the cover assembly 426, 526, 626, 726 is interrupted by a thermal spacer 444, 544, 644, 744 that exhibits reduced thermal conductivity relative to the cover assembly 426, 526, 626, 726 and the horizontal and vertical members, e.g., 414, 514, 612, 712 of the curtain wall 418, 518, 618, 718. For example, in the case of a thermal spacer 444 made from polyamide, the thermal conductivity of polyamide is 0.3 W/m·K compared to that of aluminum alloy, which is in the range of 160 W/m·K. This difference in thermal conductivity, when applied to multiple window units corresponds to a significant amount of energy transfer, especially when the temperature differential between the inside and outside environments is large.

Another aspect of the apparatus and methods of the present disclosure is the magnitude of the resultant separation distance between the interior and the exterior structures made from aluminum alloy. The separation distance provided by thermal barriers 326 TB, 312TB1, 312TB2 (FIGS. 5 and 6) is only about ⅛ inch to ¼ inch. In the present disclosure, the separation provided by the thermal spacer 444, 544, 644, 744 is greater than 1 inch. This increase in separation between the interior and exterior aluminum improves the thermal transmittance of the frame by about 40-50%.

While the present disclosure has been expressed in terms of curtain walls, which are commonly associated with large buildings, such as skyscrapers, the technology disclosed herein would also be applicable to window arrays for smaller buildings, such as stores, motels, homes, etc.

We claim:

1. A window system for a building, comprising a chassis secured to the building, the chassis having a horizontally oriented structural element, the chassis supporting a glazing unit, the horizontally oriented structural element having a niche therein along at least a portion of a length thereof;

the glazing unit secured to the horizontally oriented structural element adjacent the niche;

a cap covering an edge of the glazing unit;

a cap retainer inserted into and retained in the niche at a first end thereof and attaching to the cap at a second end, the cap retainer having a support plate made from a material having a first thermal conductivity and a thermal spacer made from a material having a thermal conductivity less than the thermal conductivity of the first material and coupled to the support plate, the support plate extending from a position within the niche to a position under the glazing unit, the thermal spacer interposed between the cap and the niche.

2. The window system of claim 1, wherein the cap retainer supports the glazing unit under the influence of gravity.

3. The window system of claim 1, wherein the support plate is a metal extrusion, the thermal spacer being non-metallic and at least partially covering the first portion.

4. The window system of claim 3, wherein the second material is a polymer material.

5. The window system of claim 4, wherein the first material is an aluminum alloy.

6. The window system of claim 2, wherein the niche has an upper interior surface and a lower interior surface and wherein a portion of the thermal spacer is positioned below the support plate and rests on a portion of the lower interior surface of the niche at a contact area, the cap retainer pivoting on the contact area and pressing the first end of the cap retainer up into engagement with the upper interior surface in response to a down-force applied on a portion of the cap retainer extending beyond the contact area in a direction distal to the niche.

7. The window system of claim 6, wherein the cap retainer has a hook at the first end thereof that is received in the niche and the niche has a hook recess in the upper interior surface thereof that matingly receives the hook when the cap retainer is inserted in the niche.

8. The window system of claim 7, wherein the niche has two hook recesses, a first for accommodating the hook when the cap retainer is inserted to a first extent into the niche and a second for accommodating the hook when the cap retainer is inserted into the niche to a second extent.

9. The window system of claim 1, wherein the thermal spacer has a first end grip and a second end grip, the first and second end grips wrapping around a first end of the support plate distal to the niche and a second end of the support plate proximal to the niche, respectively.

10. The window system of claim 1, wherein the support plate is made from a material having a greater mechanical strength than the thermal insulator and stiffens the thermal insulator when conjoined therewith, the thermal insulator covering at least a bottom surface of the support plate from a first end thereof distal to the niche to a second end thereof proximal to the niche.

11. The window system of claim 4, wherein the second material is polyamide.

12. The window system of claim 1, wherein the cap has a hollow gripper with at least one flexible wall and the cap retainer has a tapered insertion tip that is slideably insertable into the hollow gripper to a gripping position where the hollow gripper and insertion tip snap fit and interlock to retain the cap on the window system.

13. The window system of claim 12, wherein the hollow gripper has a disengagement tab on the at least one flexible wall that permits disengagement of the hollow gripper from the insertion tip.

14. The window system of claim 1, wherein the support plate is telescoped into the thermal spacer.

15. The window system of claim 8, further comprising an adapter inserted into the niche, the adapter having a Y-portion from which a niche hook, a niche engagement leg and a retainer support leg extends, the niche hook of the adapter received in the first hook recess in the niche, the niche engagement leg received in a recess in the niche and the support leg providing a support surface upon which the cap retainer rests and pivots when inserted into the niche after the adapter, the support leg intermediating between the cap retainer and the contact area on the lower interior surface of the niche, the cap retainer niche hook received in the second hook recess in the niche.

16. The window system of claim 1, wherein the chassis has a vertical structural element having a niche therein along at least a portion of a length thereof:

a vertical cap covering a vertical edge of the glazing unit;

a vertical cap retainer formed at least partially from a material having a thermal conductivity less than metal, the vertical cap retainer being secured to the vertical structural element by a fastener.

17. The window system of claim 1, wherein the cap is connected to the thermal insulator.

18. The window system of claim 1, wherein the cap is horizontally oriented.

19. The window system of claim 1, wherein the cap covers edges and a gap between a pair of adjacent glazing panels.

20. The window system of claim 16, wherein the vertical cap is formed from extruded aluminum, the chassis is extruded aluminum and the vertical cap retainer includes a first portion made from a polymer extrusion and a second portion made from an aluminum alloy extrusion, the first portion at least partially covering the surface of the second portion and mechanically coupling to the second portion, the first portion being interposed between the aluminum chassis and the vertical cap, the vertical cap attaching to an end of the first portion.

21. The window system of claim 16, wherein the vertical cap retainer is composed of a monolithic polymer having a thermal conductivity less than the thermal conductivity of the vertical structural element, the vertical cap retainer interposed between the vertical cap and the niche of the vertical structural member.

22. The window system of claim 21, wherein the vertical structural element and the vertical cap are aluminum alloy, the vertical cap has a gripper with a hollow and at least one flexible wall and the vertical cap retainer has a tapered insertion head that inserts into the hollow of the gripper.

23. The window system of claim 22, wherein the gripper of the vertical cap has a release lever extending from the flexible wall that selectively opens the gripper when pressed to allow withdrawal of the insertion head.

24. The window system of claim 21, wherein the separation distance between the cap and the horizontal structural element and between the vertical cap and the vertical structural element is greater than ¼ inch.

25. The window system of claim 21, wherein the separation distance between the cap and the horizontal structural element and between the vertical cap and the vertical structural element is greater than 1 inch.

* * * * *